US009445698B2

(12) United States Patent
Pagett

(10) Patent No.: US 9,445,698 B2
(45) Date of Patent: Sep. 20, 2016

(54) TOILET SEAT HANDLE

(71) Applicant: Patrick Pagett, Thousand Oaks, CA (US)

(72) Inventor: Patrick Pagett, Thousand Oaks, CA (US)

( * ) Notice: Subject to any disclaimer, the term of this patent is extended or adjusted under 35 U.S.C. 154(b) by 0 days.

(21) Appl. No.: 14/578,202

(22) Filed: Dec. 19, 2014

(65) Prior Publication Data

US 2015/0101114 A1 Apr. 16, 2015

Related U.S. Application Data

(63) Continuation-in-part of application No. PCT/US2013/046567, filed on Jun. 19, 2013, which is a continuation of application No. 13/526,903, filed on Jun. 19, 2012, now Pat. No. 8,402,571.

(60) Provisional application No. 62/090,208, filed on Dec. 10, 2014.

(51) Int. Cl.
*A47K 13/10* (2006.01)

(52) U.S. Cl.
CPC ..... *A47K 13/105* (2013.01)

(58) Field of Classification Search
CPC ..... A47K 13/05
USPC ..... 4/246.1–246.5
See application file for complete search history.

(56) References Cited

U.S. PATENT DOCUMENTS

| | | | |
|---|---|---|---|
| 203,713 | A | 5/1878 | Fernandez |
| 723,973 | A | 3/1903 | Alexander |
| 2,318,518 | A | 5/1943 | Opperer |
| 3,191,193 | A | 6/1965 | Bogenberger |
| 6,704,967 | B2 | 3/2004 | Gianelli et al. |
| 6,842,916 | B1 | 1/2005 | Gunn et al. |
| D507,168 | S | 7/2005 | Richard, Jr. |
| 7,137,154 | B2 | 11/2006 | Miller |
| 7,966,674 | B2 | 6/2011 | Olowofela |
| 2011/0214226 | A1 | 9/2011 | Dundas |

FOREIGN PATENT DOCUMENTS

| | | | |
|---|---|---|---|
| EP | 1917892 | 5/2008 | |
| ES | EP 1917892 A1 * | 5/2008 | ..... A47K 13/105 |
| JP | 3015362 | 8/1995 | |

OTHER PUBLICATIONS

EP 1 917 892.*

* cited by examiner

*Primary Examiner* — Lauren Crane
(74) *Attorney, Agent, or Firm* — Cislo & Thomas, LLP

(57) ABSTRACT

A toilet seat handle for lifting a toilet seat and its cover. The toilet seat handle is affixed to the toilet seat cover, and selectively engages the toilet seat to lift the cover and the seat individually or together. Because the handle mechanism is affixed to the front of the cover, when the toilet is being used, with the seat up or down, the handle mechanism is well away from the toilet, such that the handle mechanism remains clean and sanitary.

14 Claims, 8 Drawing Sheets

TOILET SEAT HANDLE

CROSS-REFERENCE TO RELATED APPLICATIONS

This patent application is a continuation-in-part application of PCT Application No. PCT/US2013/46567, filed Jun. 19, 2013, which is a continuation of U.S. application Ser. No. 13/526,903, filed Jun. 19, 2012, now U.S. Pat. No. 8,402,571, and this application claims the benefit of U.S. Provisional Application Ser. No. 62/090,208, filed Dec. 10, 2014, which applications are incorporated in their entirety here by this reference.

TECHNICAL FIELD

This invention relates to a device for lifting toilet seats in a sanitary manner, and more particularly to a novel handle attachable to the underside of the toilet seat cover so that the user may readily raise and lower the seat without touching the seat itself.

BACKGROUND ART

Toilet seats are typically raised and lowered by manually grasping the edge and lifting or lowering the seat accordingly. The seat and its cover are generally hinged at their rear edge so that the seat and cover can be rotated about the hinge pins. Many toilet users are concerned with the sanitary aspects of touching a toilet seat. In their down and operational position, toilet seats are exposed to splashing of toilet water and human wastes, contact with various body parts, and the accompanying germs and bacteria.

Some attempts have been made to provide lifting means for such seats without touching the seat itself. Many of these devices are attached to the seat, and thus are exposed to the same splashing effect and body contact as the seat itself. Other devices have attached to the seat cover, while engaging the seat in some manner, but such devices lack adjustability for various shapes of seat covers, and further lack the ability to be easily removed for cleaning, while having an effective attachment mechanism that prevents dislodgement.

Therefore, a long standing need has existed to provide a novel means for raising and lowering a toilet seat without touching the seat or anything that is connected with the seat while in use, with sufficient adjustability for various models of toilet seats, and an attachment method that allows for both easy removal and substantial security.

The above problems and difficulties are obviated by the present invention which provides a novel means for raising and lowering the seat on a toilet bowl, which is pivotally attached thereto, that incorporates a handle having an attachment portion secured to the underside of the seat cover using both hook-loop fasteners and a snap button, and including a handle portion which extends outwardly from the front edge of the seat cover for grasping. The handle is equipped with attachment means that allows for adjustment to varying designs of toilets seats for nearly universal fit. The handle is movably coupled with the attachment means and a pulley mechanism, which pulley mechanism is in turn coupled with a latch to engage the toilet seat so that the toilet seat and toilet seat cover can be lifted simultaneously.

Thus, there is a need for a device that allows a user to lift a toilet seat using a sanitary handle, while at the same time keeping the sanitary handle away from the toilet bowl during use so that it remains sanitary.

DISCLOSURE OF INVENTION

The present invention is directed to a handle mechanism for lifting a toilet seat and its cover. In a preferred embodiment, the handle mechanism is affixed to the underside of the front of a toilet seat cover, and selectively engages the toilet seat to lift the cover and the seat individually or together. Because the handle mechanism is affixed near the front of the cover, when the toilet is being used, with the seat up or down, the handle mechanism is well away from the toilet, such that the handle mechanism remains clean and sanitary.

The handle mechanism comprises a handle element with a portion that extends from the front of the toilet cover to provide a grasping surface for the handle mechanism, and another portion that extends underneath the toilet cover. The handle element is coupled with a latch element. A cradle element is adapted to receive the portion of the handle element that is underneath the toilet cover. A fixation element attaches the cradle to the toilet cover, a pulley element is attached to the cradle, and a pulley drive element is coupled with the handle element and the latch element. When the toilet cover is lowered, the latch element engages the underside of the toilet seat, so that when the handle element is lifted the toilet cover and seat are raised together. Thus, when the seat is raised, the handle mechanism is near the top of the toilet tank, well away from the toilet bowl, which keeps the handle mechanism from becoming soiled due to splashing, poor aim, and the like.

When the toilet cover is down and handle element is pulled, the latch element disengages from the toilet seat and the toilet cover may be raised by itself. Once again, during toilet use the handle mechanism is up near the top of the toilet tank so that it remains clean and sanitary.

The present invention is designed to keep the handle element clean and sanitary. The only time the handle mechanism is located close to the toilet is when the cover is closed and the toilet is incapable of being used. At that point, the only use of the toilet may be to flush it. With the cover closed, the grasping surface of the handle element protrudes between the seat and the cover. Thus, the seat would prevent any direct upward splashing from reaching the handle element, while the closed cover would prevent any indirect splashing from falling on top of the handle element. Therefore, it would take a very unusual circumstance for the grasping surface of the handle element to come into contact with any direct splashing from the toilet or its users.

The fixation element is comprised of industrial strength hook and loop fasteners, with a snap button embedded in the hook and loop fabric. This combination of a snap button and a hook and loop fastener provides a sturdy attachment apparatus that will not become dislodged by ordinary bumps, but is readily removable when desired.

BEST MODE FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
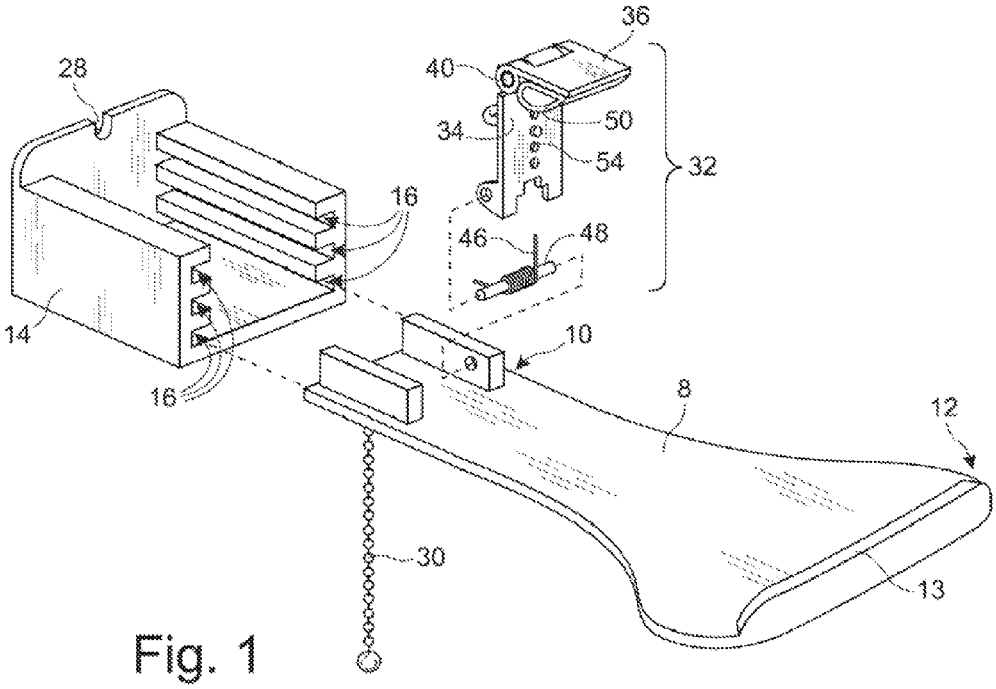
FIG. 1 is an exploded perspective view of the underside of an embodiment of the present invention.
Figure 2:
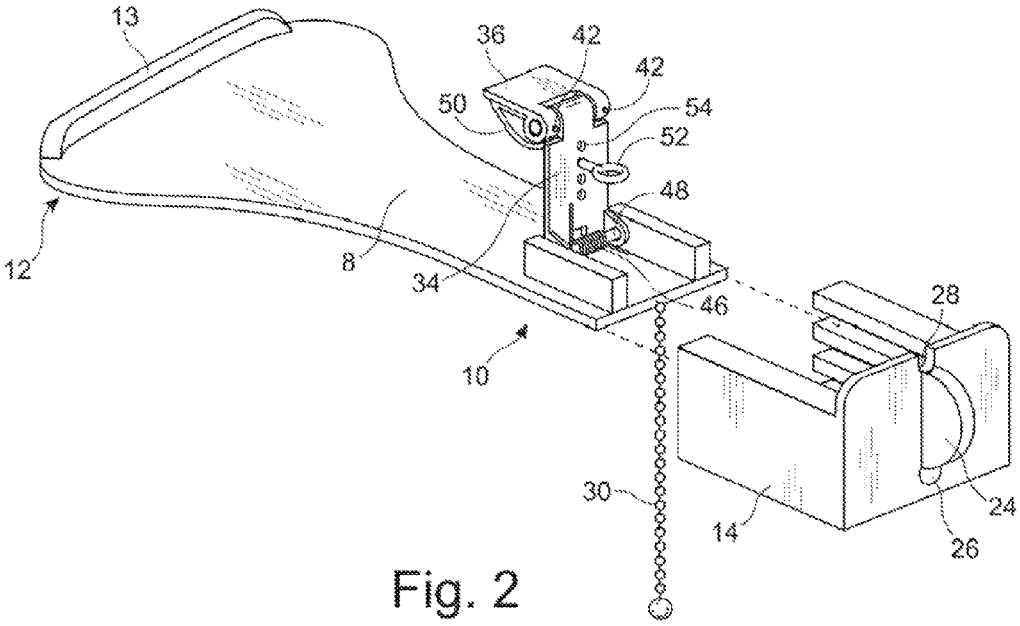
FIG. 2 is a perspective view of the embodiment shown in FIG. 1 from the opposite side.
Figure 3:
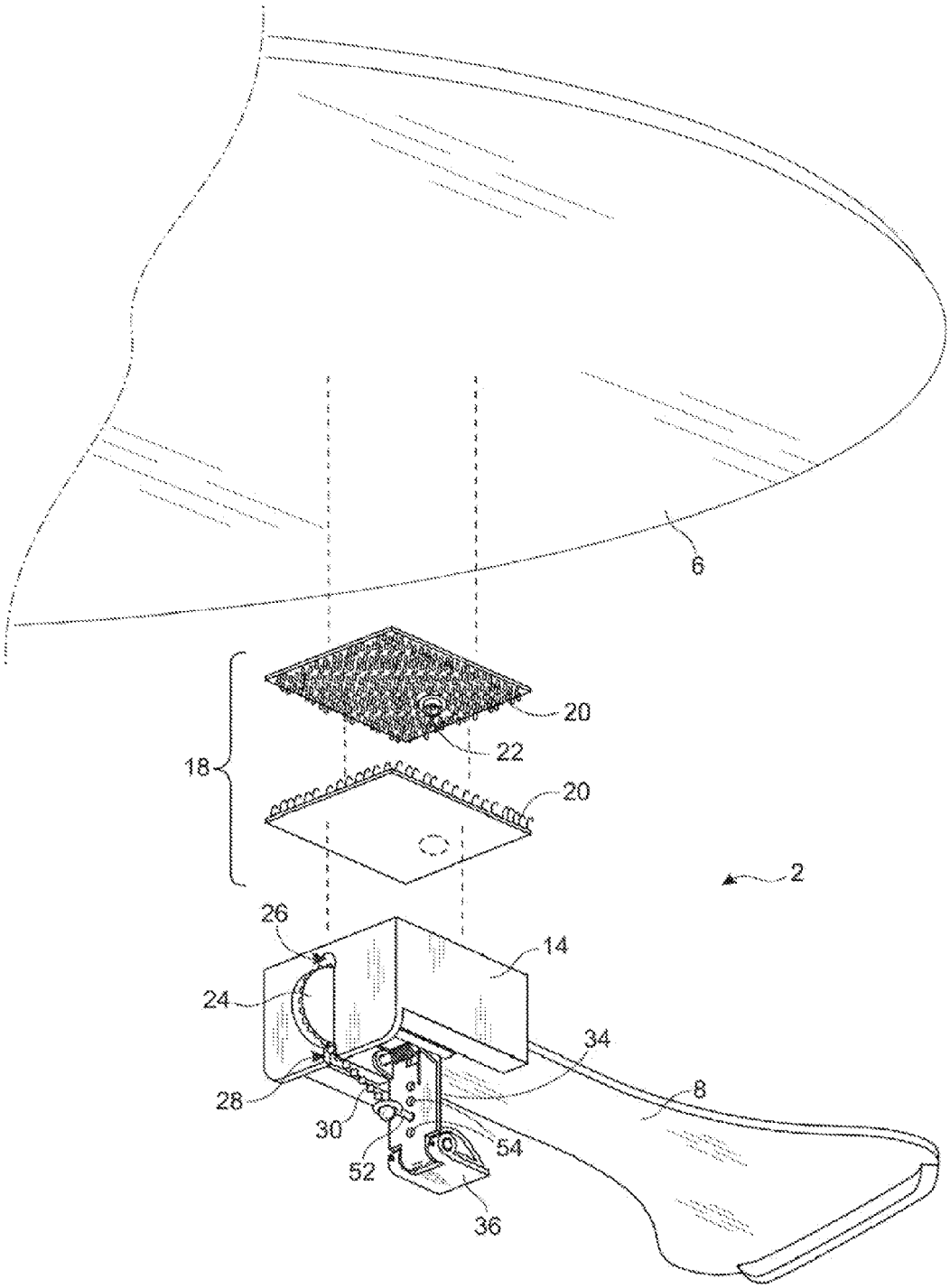
FIG. 3 is a perspective view of the underside of the embodiment shown in FIG. 1 also depicting a toilet seat cover and an exploded view of the fixation element.
Figure 4:
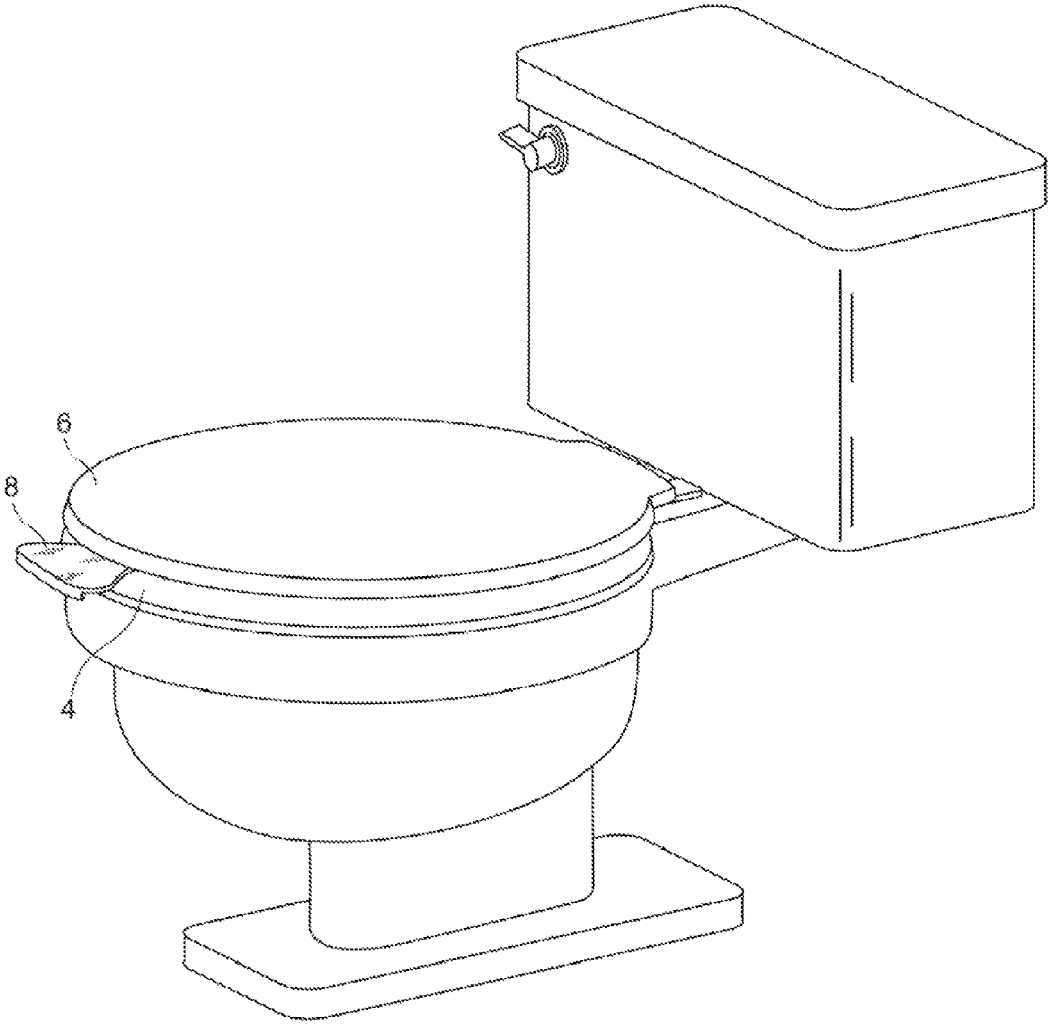
FIG. 4 is a depiction of an embodiment of the present invention as it would appear when mounted on a closed toilet cover.

As shown in FIGS. 1-3, a preferred embodiment of the present invention comprises a handle mechanism 2 for lifting a two-piece toilet seat having a toilet seat 4 and a toilet cover 6. The handle mechanism 2 comprises a handle element 8 that is preferably made of thermoplastic, acrylic, or other suitable lightweight, low-cost, high-impact material that can withstand the environment of a toilet seat. Such material should be non-corrosive, non-porous, and easy to sanitize. The handle element 8 may have two ends, distal 10 and proximal 12. When the handle mechanism 2 is mounted on a toilet seat cover 6, as shown in FIGS. 3-8, the proximal end 12 of the handle element 8 extends beyond the edge of the toilet cover 6 proximal to the user to act as a grasping surface, while the distal end 10 remains underneath the toilet cover 6.

The proximal end 12 of the handle element 8 may have a variety of shapes adapted to act as a grasping surface. In a preferred embodiment it may have a broad, flat shape with a small lip 13, but may have many other suitable shapes. The proximal end 12 may have logos, advertising, or other symbols or words, including instructions for use. The proximal end 12 may also be constructed of, and/or be coated with, a luminescent material that glows in the dark, to assist a user in finding the handle in a dark restroom. The proximal end 12 could even be fitted with a small light, such as an LED with a small battery and a photocell, to light the handle at night.

The handle element 8 is fitted inside a cradle 14. As shown in FIGS. 1 and 2, the cradle 14 is adapted to receive the distal end 10 of the handle element 8. In a preferred embodiment, the cradle 14 is adapted to slidably receive the distal end 10 of the handle. Such adaptations may take the form of slots 16 to receive a planar distal end 10 of the handle element 8, or could be any variety of suitable male and female parts that are adapted to receive each other, such as rails, tongue and groove, and the like.

The cradle 14 is adapted to couple with a toilet cover 6 via a fixation element 18. In a preferred embodiment, shown in FIG. 3, the fixation element 18 may comprise industrial-strength hook and loop fasteners 20, such as Velcro®. The hook and loop fasteners 20 may also be equipped with a snap fastener or snap button 22, commonly used on clothing. The snap button 22 may be embedded into the Velcro® fabric. The combination of the hook and loop 20 and snap button 22 tend to provide increased fastening power over their individual use. Such increased fastening power may be useful in retaining the cradle 14 on the toilet cover 6 while the handle element 8 is bumped and jostled by users, but allowing the handle mechanism 2 to be removed when necessary or desired, such as when cleaning the toilet.

Other fixation elements could be utilized to fasten the cradle 14 to the toilet cover 6. These might include screws, adhesives, tape, slots, or other suitable fastening mechanisms. Alternatively, the cradle 14 could be molded directly into the toilet cover 6.

Modern toilet covers have a wide variety of shapes, and many are not flat. As shown in FIGS. 1 and 2, the cradle 14 may have a plurality of slots 16 that are adapted to receive the distal end 10 of the handle element 8 to provide a height adjustment of the handle element 8 to accommodate a variety of toilet cover configurations. Although the slots 16 are shown to hold the flat distal end 10 of the handle element 8, those skilled in the art will appreciate that a wide variety of configurations could be used. The plurality of slots 16 in the cradle 14 allows the handle element 8 to be placed at the appropriate elevation so that the handle element 8 does not contact and/or bind on the toilet seat 4 and/or the toilet cover 6.

As shown in FIGS. 2 and 3, the cradle 14 is equipped with a pulley element 24, which, in a preferred embodiment, is a half-circle with a groove and two outside flanges. Adjacent to the top and bottom sides of the pulley there is a corresponding top opening 26 and a bottom opening 28 in the cradle 14. These openings accommodate a pulley drive element 30 that is routed around the pulley element 24. Depending on the configuration of the cradle 14, these openings could encircle the pulley drive element 30 or could be open.

A latch element 32 may be hingably coupled via a hinge 38 with the handle element 8. In a preferred embodiment shown in FIGS. 1 and 2, the latch element 32 is comprised of two sub-elements, an upright 34 and a hook 36. The upright 34 is hingably coupled via a hinge 48 with the underside of the handle element 8, and is configured at a relatively acute angle along its length to the underside of the handle element 8, and may be spring-loaded to bias it towards the proximal end 12 of the handle. On the bottom portion of the of the latch element 32 is a hook 36, which may be hingably attached via hinge 40 to the upright 34, and the hook 36 may be spring loaded to bias it downwards, away from the handle element 8 and away from the cradle 14. In a preferred embodiment, the hook 36 is equipped with stops in the hinge area to keep it from rotating too far, as the stops engage the upright 34 to stop the rotation of the hook 36. Although the stops are shown as protrusions 42 on the hinge knuckle, they may be formed into the knuckle itself, or the hinge could have corresponding knuckles that prevent over-rotation of the hinge, or any other suitable apparatus for limiting the ability of the hinge to open past a prescribed point.

Two types of spring loading are shown in FIGS. 1 and 2. The upright 34 is shown with a standard coil spring 46 around a pivot bar 48. The hook 36 is shown with a hollow, resilient rubber or vinyl tube 50, similar to those used in door gaskets. This tube 50 is flexible, to allow the hook 36 to fold towards the upright 34, but is resilient to spring back into shape when pressure is released. The tube 50 also acts as a cushion for when the hook 36 engages the toilet seat, as explained below and shown in FIG. 5. Despite the advantage of the tube 50 on the hook 36, the tube 50 is not required, and the hook 36 may be spring loaded with a standard coil spring or other suitable biasing mechanism. Although these two types of spring loading are shown and described, those skilled in the art will appreciate that other types of spring loading or biasing may be used.

As shown in FIGS. 2 and 3, the upright 34 of the latch element 32 may be equipped with a retention element 52. As shown in FIGS. 1, 2, 3, and 5, a pulley drive element 30 may be coupled at a first end with the distal portion 10 of the handle element 8, and coupled at a second end with the latch element 32 via the retention element 52 that is coupled with the upright 34. The upright 34 may be equipped with holes 54 or slots to allow the retention element 52 and/or the hook 36 to be adjusted. The retention element 52 may comprise a screw eye with a machine thread and one or more nuts to secure it to the upright 34 and/or hook 36. The upright 34 and/or hook 36 may be equipped with one or more holes 54 or slots so that the height of the hook 36 and/or retention element 52 may be adjusted by placing the threaded portion of the screw eye in the appropriate hole or at the appropriate location on the slot, or a combination thereof, and securing the nut(s) onto the screw threads. As will be appreciated by those skilled in the art, various other securing and/or adjustment apparatus could be used.

As shown in FIG. 3, the middle portion of the pulley drive element 30 may be routed around the pulley element 24, and the two ends are respectively routed through the top opening 26 and the bottom opening 28 in the cradle 14. The pulley drive element 30 is shown in the Figures as a ball chain, which allows for easy adjustability of its length to customize and/or adjust the handle mechanism 2 to engage or disengage the toilet seat, as discussed below. The length of a ball chain is easily adjusted by changing the position of the coupler or connector to a different ball on the chain. But the pulley drive element 30 could be any type of wire, cable, string, or other material that has sufficient tensile strength and resistance to stretch to effectively operate the handle mechanism, while flexible enough to bend and travel around the pulley element 24. Adjustment of the pulley drive element 30 may or may not be necessary or desired.

Figure 9:
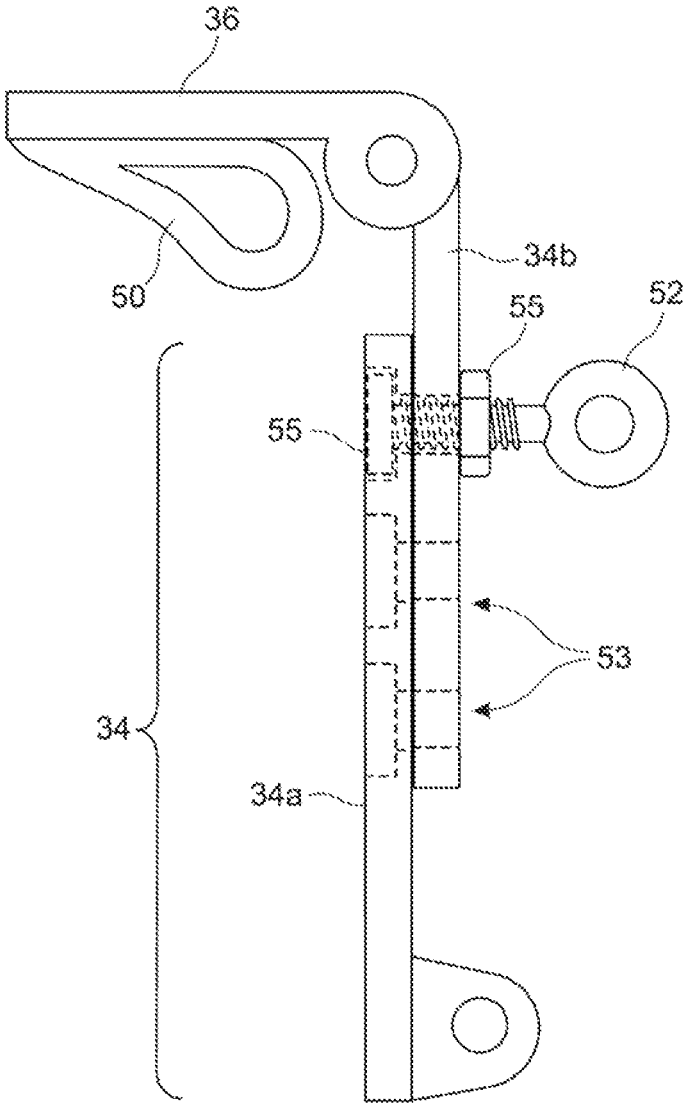
FIG. 9 is a side view of another embodiment of the upright.

In another embodiment, the upright 34 may comprise more than one piece. As shown in FIG. 9, the upright may have two portions, 34*a* and 34*b*. The upright 34*a* attaches to the handle element 8, while upright 34*b* attaches to the hook 36. A retention element 52 may comprise a screw eye with a machine thread, the threaded portion inserted through holes 53 (shown by dashed lines in FIG. 9) in uprights 34*a* and 34*b*, with nuts 55 on either side of the upright 34*a* and 34*b* to secure the retention element 52. In some embodiments, the nut 55 may be inside the hole 53 of upright portion 34*a*. The uprights 34*a* and 34*b* may have one or more holes in them, in any combination, to allow the height of the upright 34 to be adjusted. Either upright 34*a* or 34*b*, or both, could be equipped with a protrusion that would match the holes in the corresponding upright portion, to increase the stability of the upright 34. The nuts and retention element could be other shapes and hardware, as would be chosen by one of ordinary skill in the art.

Figure 5:
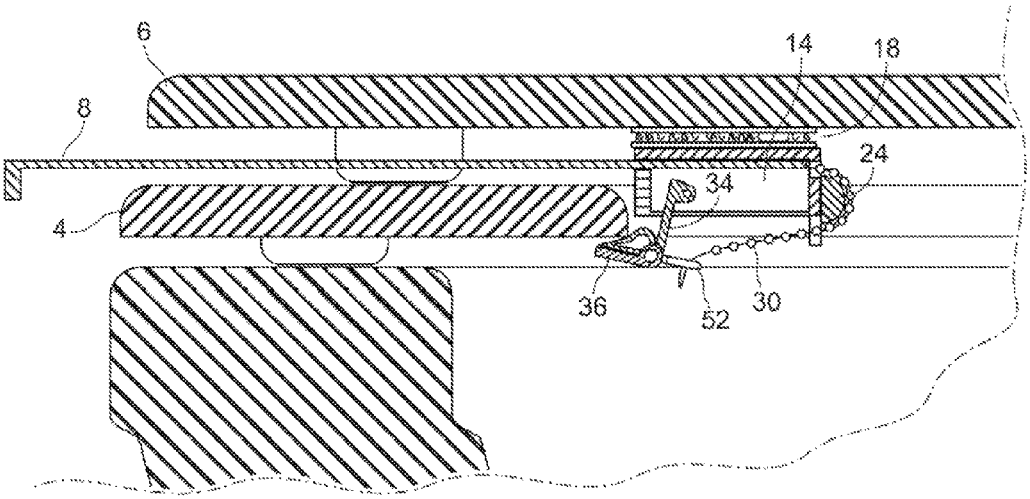
FIG. 5 is a cross section view from the side of a toilet of an embodiment of the present invention mounted on a toilet cover and engaging a toilet seat.
Figure 6:
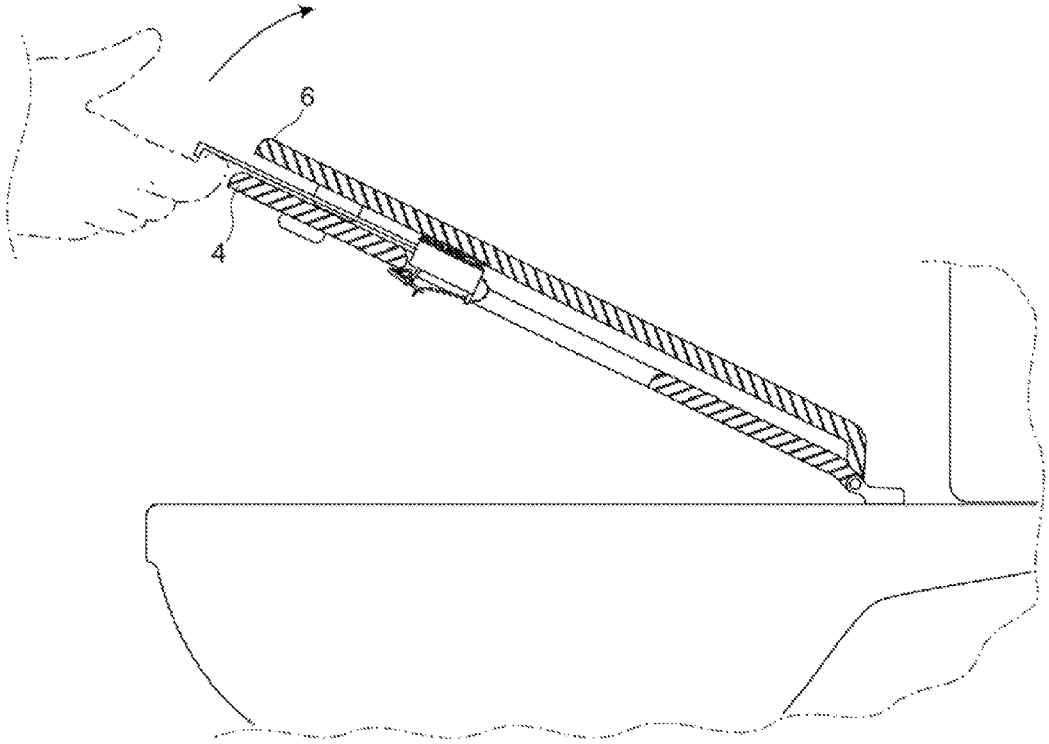
FIG. 6 is a cross section view of the embodiment shown in FIG. 5 and depicting how the invention can be used to lift both the toilet seat and toilet cover.

In operation, a preferred embodiment of the handle mechanism 2 is mounted to the underside of a toilet cover 6 by fastening the adhesive side of the industrial Velcro® hook and loop fastener fixation element 18 to the toilet cover 6. Preferably this would be the "hook" side of the hook and loop fastener 20, as the hooks are a bit easier to clean than the "loop" side, and thus the "hook" side is better to leave fastened to the toilet cover 6 when the handle mechanism 2 is removed. The corresponding portion of the hook and loop fastener 20 is fastened via its adhesive to the top portion of the cradle 14. Each side of the hook and loop fastener 20 is further equipped with a snap fastener 22. The snap fasteners 22 are aligned and the two sides of the hook and loop fastener 20 are pushed together, securing the hook and loop fastener 20 and the snap fastener 22. The user may then align the handle element's distal portion with the slots 16 in the cradle 14 so that the proximal portion of the handle element 8 protrudes from the edge of the toilet cover 6. The user may select the appropriate slot in the cradle 14 to allow the handle element 8 to be placed at the appropriate elevation so that the handle element 8 does not contact and/or bind on the toilet seat 4 and/or the toilet cover 6 when the toilet cover 6 is down. The pulley drive element 30 is attached to the distal portion of the handle element 8, and the user then routes the pulley drive element 30 around the pulley element 24 and connects the second end of the pulley drive element 30 to the retention element 52 that is coupled with the upright 34 of the latch element 32. When the toilet cover 6 is lowered onto the seat, the top of the toilet seat 4 touches the bottom portion of the hook 36, which pivots on its hinge to swing out of the way while the toilet cover 6 is further lowered and the hook 36 is moved past the toilet seat. The spring loading in the upright 34 and handle element pivot may also assist in moving the hook 36 sufficiently out of the way to clear the toilet seat. Once the toilet cover 6 is fully lowered, the hook 36 clears the toilet seat 4 and its spring loading pushes the hook 36 downwards, below the toilet seat. Thus, when the proximal portion of the handle element 8 is lifted, the hook 36 will engage the bottom of the toilet seat, and lift the toilet seat 4 and toilet cover 6 together, as shown in FIGS. 5 and 6. In other words, when the toilet cover 6 is lowered onto the toilet seat 4, the latch element 32 engages the underside of the toilet seat 4 and the toilet cover 6 can be lifted together by holding only the proximal end 12 of the handle element 8. The spring loading or biasing of the latch element 32 keeps the latch element 32 engaged to the underside of the toilet seat 4 until the user pulls the handle element 8 outward, as explained below.

Figure 7:
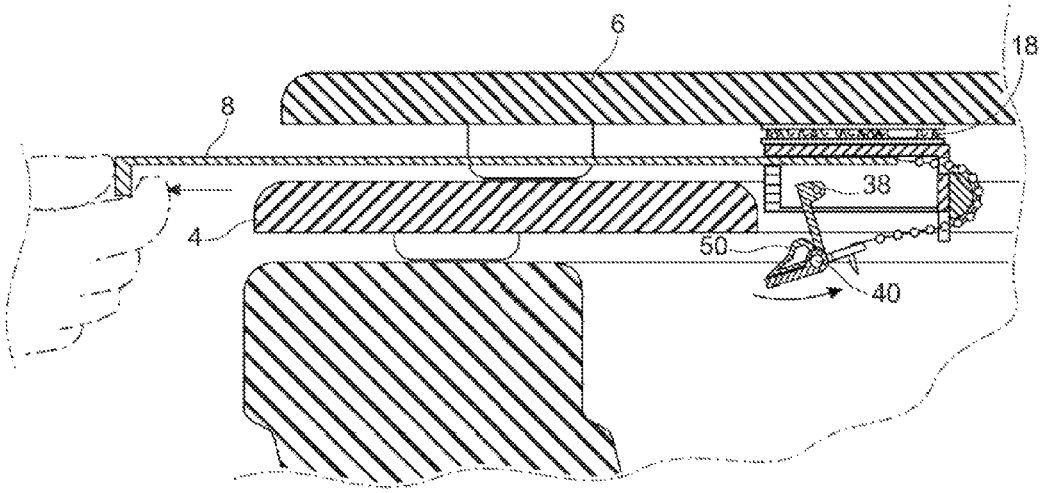
FIG. 7 is a cross section view of the embodiment shown in FIG. 5 and depicting how the invention is disengaged from the toilet seat.
Figure 8:
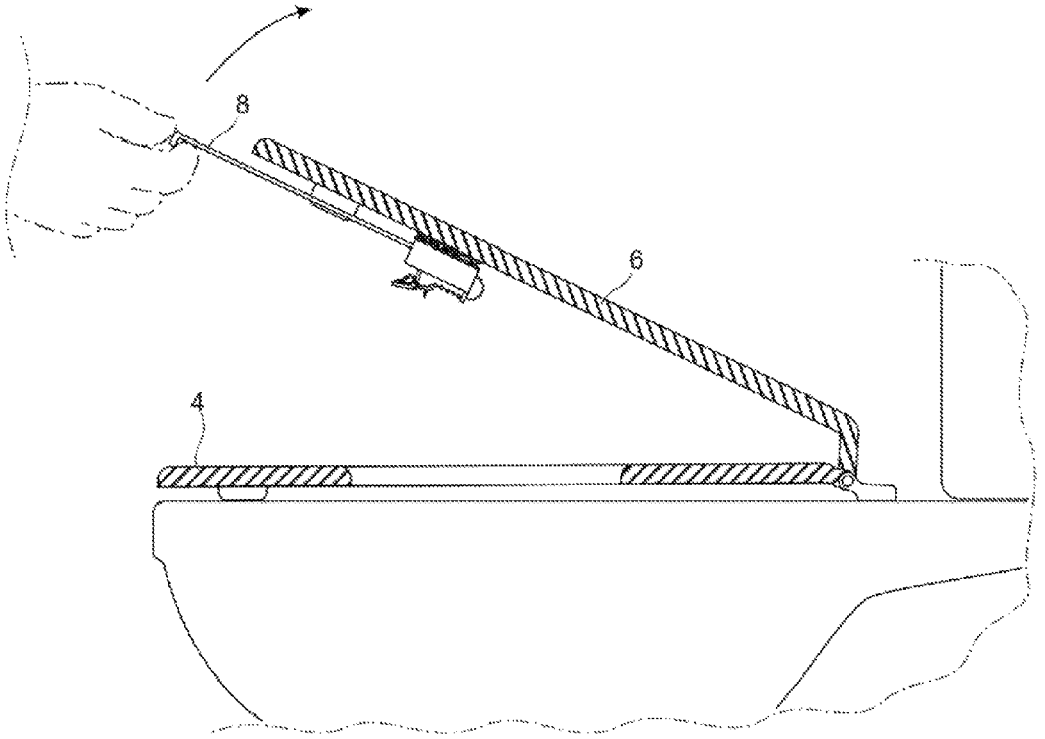
FIG. 8 is a cross section view of the embodiment shown in FIG. 5 and depicting how the invention can be used to lift the toilet cover alone.

In further operation of a preferred embodiment, when the toilet cover 6 is down and the user wants to lift the toilet cover 6 alone, he or she operates the handle mechanism 2 as follows. As shown in FIGS. 7 and 8, the user pulls on the proximal end 12 of the handle element 8, which in turn pulls the pulley drive element 30, which in turn pulls on the retention element 52 that is coupled with the latch element 32 (comprising the hook 36 and upright 34), pulling the hook 36 clear of the toilet seat 4 so that the toilet cover 6 can be lifted alone. Thus, pulling on the proximal end 12 of the handle element 8 away from the toilet cover 6 and toilet seat 4 causes the pulley drive element 30 to pull the latch element 32 away from the underside of the toilet seat 4, thus disengaging the toilet seat 4 from the handle mechanism.

Alternatively, the latch element 32 may not be spring loaded or biased. The handle mechanism 2 may be operated manually, so that when the handle element 8 is pushed in, the latch element 32 engages the toilet seat 4. The handle element 8 would then have to be pulled out to disengage the toilet seat 4. The handle element 8 could operate freely so that its movement is not encumbered. Alternatively, there could be a friction or detent mechanism built into at least one of the elements so that the latch element 32 is held in place until the user moves the proximal end 12 of the handle element 8 to change the position. Such friction or detent mechanism would keep the latch element 32 engaged or disengaged with the toilet seat 4 when the user releases the handle element 8, as opposed to the handle element 8 or other elements moving due to their own weight or movement of the toilet seat 4 or cover.

In an alternative embodiment, the hook 36 could be disengaged with the toilet seat 4 by pushing on the proximal end 12 of the handle element 8. This could be accomplished by directly coupling the handle element 8 to the latch element 32, eliminating the direction-reversing pulley element 24 and pulley drive element 30. The handle element 8 and/or latch element 32 could be spring loaded, biased toward the proximal end 12 of the handle element 8, or they could be held in place by friction, detents, or other suitable mechanical apparatus.

Figure 10:
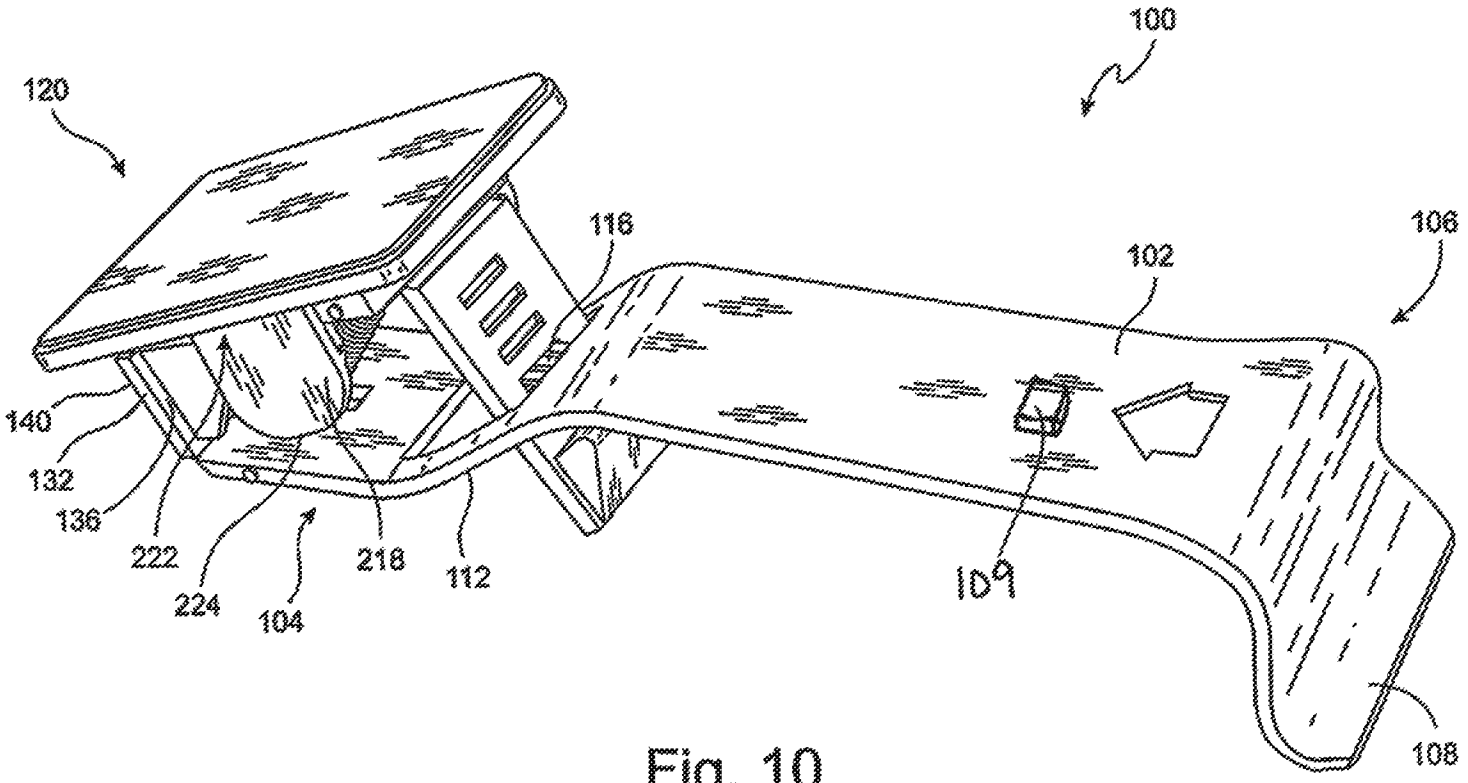
FIG. 10 is a perspective view of another embodiment of the present invention.
Figure 11:
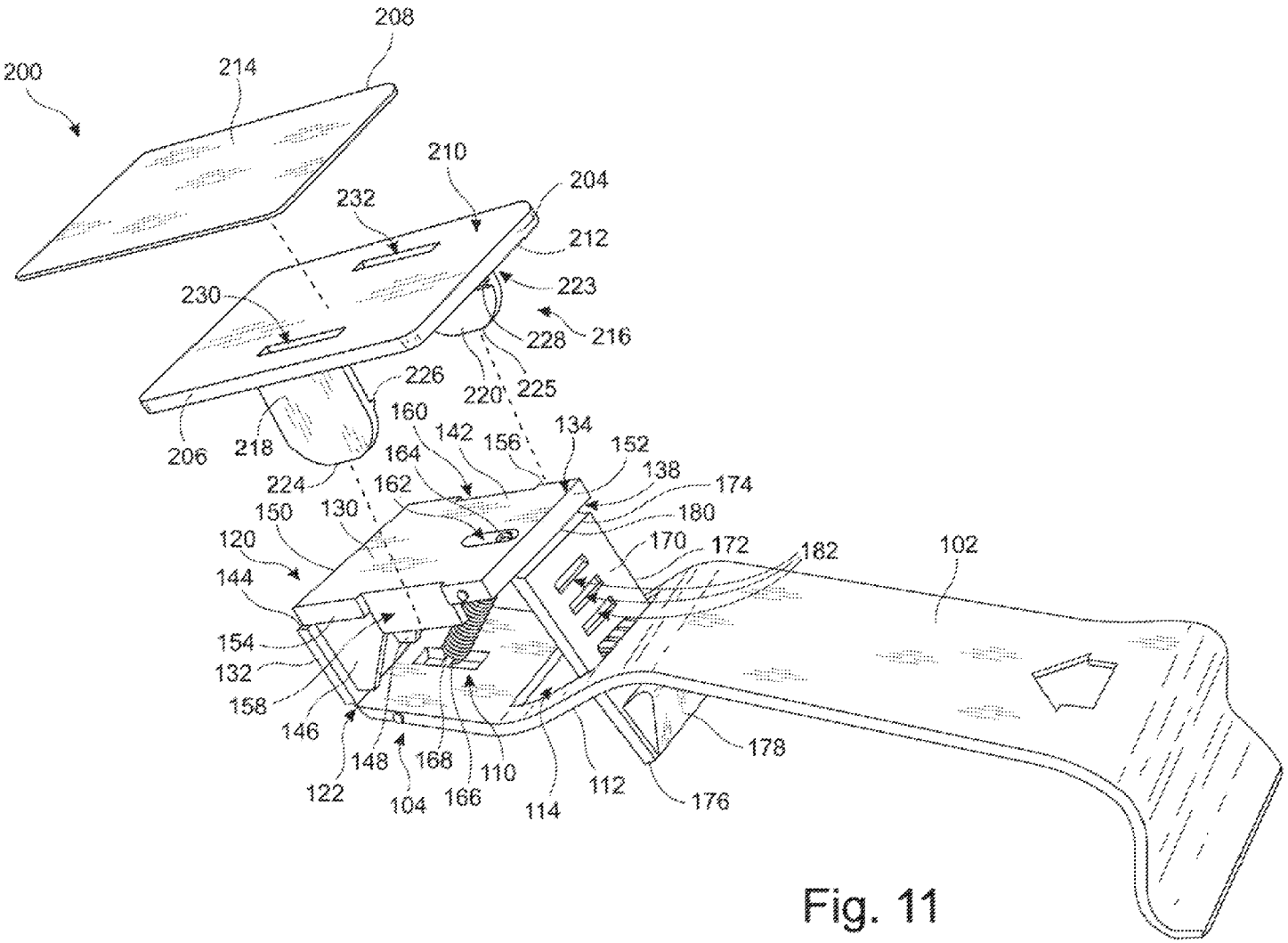
FIG. 11 is an exploded view of the embodiment shown in FIG. 10.

In another embodiment, toilet seat handle may be configured so that pushing in on the handle causes the toilet cover 6 to be released from the toilet seat 4. As shown in FIGS. 10-11, a preferred embodiment of the present invention comprises a handle mechanism 100 attached to a cradle 200 for lifting a two-piece toilet seat having a toilet seat 4 and a toilet cover 6.

The handle mechanism 100 comprises a handle element 102 that is preferably made of thermoplastic, acrylic, or other suitable lightweight, low-cost, high-impact material that can withstand the environment of a toilet seat. Such material should be non-corrosive, non-porous, and easy to sanitize. The handle element 102 may have two ends, a distal end 104 and a proximal end 106. When the handle mechanism 100 is mounted on a toilet seat cover 6, similar to what is shown in FIGS. 3-8, the proximal end 106 of the handle element 102 extends beyond the edge of the toilet cover 6 proximal to the user to act as a grasping surface, while the distal end 104 remains underneath the toilet cover 6.

The proximal end 106 of the handle element 102 may have a variety of shapes adapted to act as a grasping surface. In a preferred embodiment it may have a broad, flat shape with a small lip 108, but may have many other suitable shapes. The proximal end 106 may have logos, advertising, or other symbols or words, including instructions for use. The proximal end 106 may also have a lighting mechanism 109. For example, the proximal end 6 may be constructed of, and/or be coated with, a luminescent material that glows in the dark, to assist a user in finding the handle in a dark restroom. The proximal end 106 could even be fitted with a small light 109, such as an LED with a small battery and a photocell, to light the handle at night, as shown in FIG. 10.

The distal end 104 is also generally flat in shape. The distal end 104 further comprises an opening 110. In the preferred embodiment, the handle element 102 comprises a slope 112 in between the proximal end 106 and the distal end 104. Due to the slope 112, the distal end 104 is positioned below the proximal end 106 properly installed on a toilet cover 6. On the slope is a hole 114. Projecting into the hole 114 in the direction from the proximal end 106 towards the distal end 104 is a small projection 116. Since the proximal end 106 is offset from the distal end 104 by the slope 112, a generally "U"-shaped space is created by the lip 108, the proximal end 106, and the slope 112 allowing the handle element 102 to fit onto the toilet seat 6.

The handle element 102 is attached to a latch element 120. The latch element 120 interacts with the handle element 102 to lift the toilet seat 4 and toilet cover 6 together, or the toilet cover 6 by itself. The latch element 120 may be hingably coupled via a hinge 122 with the handle element 102. In the preferred embodiment, the hinge 122 is a living hinge. In some embodiments, the latch element 120 is comprised of two sub-elements, a base 130 and a hook 170. The base 130 is hingably coupled via the hinge 122 with the handle element 102. The base 130 attaches to the cradle 200, while the hook 170 attaches to the toilet seat 4.

The base 130 comprises a support 132 and a foundation 134. Preferably, the support 132 and the foundation 134 are in the shape of a rectangle, each having an inner side 136, 138 and the outer side 140, 142, respectively. The support 132 and the foundation 134 are movably connected to each other. Preferably, the support 132 and the foundation 134 may be connected by a hinge 144. Most preferably, the hinge 136 is a living hinge. Other forms of connection may be utilized that allow the support 132 and the foundation 134 to move relative to each other.

When fully assembled, the support 132 and the foundation 134 generally form a right angle as measured along their respective inner sides 136, 138. In some embodiments, one or more brackets 146, 148 may be connected to the inner side 136 of the support 132 or the inner side 138 of the foundation 134. The brackets 146, 148 may be in the shape of a triangle, and in particular, a right triangle. The right angle of each bracket may be positioned in the corner where the support 132 and foundation 134 meet to form a right angle. This allows the bracket 146, 148 to prevent the inner side 136 of the support 132 from bending towards the inner side 138 of the foundation 134 to form an acute angle.

The foundation 134 has a first edge 150, a second edge 152 opposite the first edge 150, a third edge 154 adjacent to the first and second edges 150, 152, and a fourth edge 156 opposite the third edge for and adjacent to the first and second edges 150, 152. In the preferred embodiment, since the foundation 134 is generally rectangular, the first and second edges 150, 152 are parallel to each other and perpendicular to the third and fourth edges 154, 156. The first edge 150 is connected to the support 132 and the second edge 152 is connected to the hook element 170. In the preferred embodiment, the third and fourth edges 154, 156 each form a notch 158, 160. The notch 158, 160 allows the foundation 134 to be removably attached to the cradle 200, as will be discussed below.

Adjacent to the second edge 152 of the foundation 134 is an opening 162. Inserted within the opening 162 is a rod 164 generally parallel to the second edge 152. The rod 164 is attachable to one end of a spring 166. The opposite end of the spring 166 may be attached to the distal end 104 of the handle element 102 or to the support 132. In either case, the attachment may be by similar means. In the example shown in the figures, the spring 166 is attached to the distal end 104 of the handle element 102. The distal end 104 of the handle element 102 comprises an opening 110 adjacent to the support 132. A second rod 168 is inserted within the opening 110 in parallel with the first rod 164. Tension in the spring 166 pulls the first rod 164 towards the second rod 168. Due to the described configuration, a force is applied to the distal end 104 of the handle element 102 to move in the direction of the proximal end 106.

Protruding downwardly from the second edge 152 of the foundation 134 is a hook element 170. The hook element 170 comprises an upright or stem 172 having a first end 174 connected to the second edge 152 of the foundation 134, and a second end 176 comprising a protrusion 178. The first end 174 of the stem 172 may be movably connected to the second edge 152 of the foundation 134 to allow the stem 172 to move towards the proximal end 106 or the distal end 104. Preferably, the first end 174 of the stem 172 is connected to the second edge 152 of the foundation 134 by a living hinge 180.

In general, the stem 172 hangs, down below the foundation 134 generally parallel to the support 132. The stem comprises a plurality of slots 182 arranged in series from the first end 174 to the protrusion 178. The handle element 102 and the latch element 120 are configured so that when the stem 172 hangs down below the foundation 134, the stem 172 passes through the hole 114 of the handle 102. The slots 182 are configured to independently receive the projection 116. By selecting the slot 182 that receives the projection 116, the user can determine how far the protrusion 178 of the stem 172 projects below the proximal end 106 of the handle element 102. This can be utilized to adjust the latch element 120 to fit different toilet seats 4 with different thicknesses.

The handle element 102 is fitted inside a cradle 200. As shown in FIGS. 10 and 11, the cradle 200 is adapted to receive the latch element 120. In a preferred embodiment, the cradle 200 has generally a flat rectangular shape having a first edge 202, a second edge 204 opposite the first edge 202, a third edge 206 adjacent to the first edge 202 and the second edge 204, and a fourth edge 208 opposite the third edge 206 and adjacent to the first edge 202 and the second edge 204. The edges 202, 204, 206, 208 define a first side 210 and a second side 212 opposite the first side 210. The first side 210 is generally flat and is attachable to the toilet cover 6. The first side 210 may comprise a fixation element 214 such as screws, adhesives, tape, slots, snap buttons, hook and loop fasteners, or other suitable fastening mechanisms, or any combination thereof. Alternatively, the cradle 200 could be molded directly into the toilet cover 6. In the preferred embodiment, fixation element 214 is an adhesive.

The second side 212 comprises a fastening mechanism 216 to attach to the handle element 102. In the preferred embodiment, the fastening mechanism 216 is a pair of bilaterally arranged tabs 218, 220 projecting downwardly from the second side 212. In particular, the tabs 218, 220 project downwardly from the second surface 212 away from the first surface, and perpendicular to the second surface 212. Preferably, the tabs 218, 220 are spaced apart from each other wide enough receive the foundation 134. In particular, the notches 158, 160 along the third and fourth edges 154, 156 of the foundation 134 are configured to seat the tabs 218, 220 within the notches 158, 160 so as to prevent any horizontal movement (forward, back, left, right) of the foundation 134 within the cradle 200. Each tab 218, 220 has a fixed end 222, 223 attached to the second side 212 of the cradle 200, and a free end 224, 225 opposite the fixed end 222. Presented horizontally along each tab 218, 220 in between the fixed end 222, 223 and the free end 224, 225 and protruding into the space defined by the tabs 218, 220 are a pair of lips 226, 228, one on each tab 218, 220, projecting towards each other. Once the foundation 134 is properly seated in the cradle 200, the tabs 218, 220 secure the foundation 134 from horizontal movement and the lips 226, 228 slide under the foundation to prevent vertical movement of the foundation 134. To release the foundation 134 from the cradle 200, the user spreads the tabs 218, 220 apart enough to allow the foundation 134 to pass by the lips 226, 228.

In some embodiments, the cradle 200 may further comprise a pair of slits 230, 232, one slits adjacent to each tab 218, 220 on the interior side. The foundation 134 may comprise its own tabs that slide into the slits 230, 232 of the cradle 200 for a secure fit.

In some embodiments, the fixation element 214 may comprise industrial-strength hook and loop fasteners, such as Velcro®. The hook and loop fasteners may also be equipped with a snap fastener or snap button as discussed above. The snap button may be embedded into the Velcro® fabric. The combination of the hook and loop and snap button tend to provide increased fastening power over their individual use. Such increased fastening power may be useful in retaining the cradle 200 on the toilet cover 6 while the handle element 8 is bumped and jostled by users, but allowing the handle element 102 to be removed when necessary or desired, such as when cleaning the toilet.

Other fixation elements could be utilized to fasten the cradle 200 to the toilet cover 6. These might include screws, adhesives, tape, slots, or other suitable fastening mechanisms. Alternatively, the cradle 200 could be molded directly into the toilet cover 6.

One way of installing the handle mechanism 100 onto the toilet seat 4 is to first attach the cradle 200 to the foundation 134 of the latch element 120 by sliding the tabs 218, 220 of the cradle 200 in between the notches 158, 160 of the foundation 134 of the latch element 120 until the surface of the foundation 134 is flush against the second side 212 of the cradle 200 and the lips 226, 228 on the tabs 218, 220 are underneath the foundation 134, thereby exposing the fixing element 214 of the cradle 200. In this example, the fixing element 214 will be an adhesive with a backing.

The user can place the proximal end 106 on top of the forward portion of the toilet seat 4 so that the lip 108 of the handle element 102 abuts against the outer ring of the toilet seat 4, and the slope 112 abuts against the inner ring of the toilet seat 4. The user can adjust the latch element 120 by inserting the projection 116 of the handle element 102 into one of the slots 182 of the stem 172 of the hook 170. The slot 182 selected should allow the protrusion 178 of the stem 172 to catch underneath the inner ring of the toilet seat 4.

The user can then peel the backing off of the fixing element 214 and lower the toilet seat lid 6 so that the fixing element 214 makes contact with the inside of the lid 6. If necessary, the user can lift both the seat and the lid and assure that the cradle 200 is attached to the lid 6. The sequence of steps for installing the handle mechanism can be varied as desired.

In use, if the user wants to use the toilet with the seat 4 down, the user pushes the handle element 102 inwardly towards the back of the toilet. Since the cradle is fixed to the toilet lid, and since the distal end 104 of the handle element 102, the support 132, the foundation 134, and the hook 170 are connected by hinges in series, movement of the proximal end 106 of the handle element 102 towards the distal end 104 causes the hook 170 to move inwardly towards the back of the toilet. This dislodges the hook 170 from the toilet seat 4. Lifting the proximal end 106 of the handle element 102 thereby causes the lid 6 to be lifted, but not the seat 4. When the user is finished, the user can grasp the proximal end 106 of the handle element 102 and lower the lid 6 back down on top of the toilet seat 4. Due to the ramped face on the protrusion 178 of the hook 170, the hook is temporarily displaced towards the distal end 104 to allow the protrusion 178 to pass below the toilet seat 4. Once past below the toilet seat 4, the spring pulls the hook 170 in the forward direction towards the proximal end 106 to allow the protrusion 178 to engage the lower surface of the toilet seat 4.

If the user wants to lift the toilet seat 4, the user simply raises they proximal end 106 of the handle element 102 without pushing it inwardly. Since the protrusion 178 of the hook 170 is caught underneath the toilet seat 4, the toilet seat rises with the proximal end 106.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

INDUSTRIAL APPLICABILITY

This invention may be industrially applied to the development, manufacture, and use of a device for lifting and lowering toilet seats in a sanitary manner with a handle secured to the underside of the seat cover using fastener mechanisms. The device includes a handle portion which extends outwardly from the front edge of the seat cover for grasping. The handle is equipped with attachment means that allows for adjustment to varying designs of toilets seats for nearly universal fit. The handle is movably coupled with the attachment means and a pulley mechanism. The pulley mechanism is in turn coupled with a latch to engage and disengage from the toilet seat so that the toilet seat and toilet seat cover can be lifted simultaneously or independently.

What is claimed is:

1. A toilet seat handle for lifting a toilet seat and a toilet cover, comprising:

a. a handle element, comprising:

i. a distal end, the distal end defining a first opening, ii. a proximal end opposite the distal end, wherein when the toilet seat handle is mounted on the toilet seat, the proximal end of the handle element extends beyond an edge of the toilet cover to provide a grasping surface, while the distal end remains underneath the toilet cover, iii. a slope in between the proximal end and the distal end, wherein when installed, the distal end is positioned below the proximal end due to the slope, the slope comprising a hole, and a small projection projecting into the hole from the proximal end towards the distal end, b. a latch element hingably coupled via a first hinge with the handle element, wherein the latch element comprises a base attached to the handle element, and a hook attached to the base, wherein the base comprises a support, a foundation attached to the support, and a pair of brackets abutting the foundation and the support, wherein the support and the foundation are each in the shape of a rectangle, each having an inner side and an outer side opposite the inner side, wherein the support and the foundation are movably connected to each other by a second hinge, the foundation comprising bilaterally arranged notches, an opening therebetween, and a rod inside the opening, the rod attached to one end of a spring, the opposite end of the spring attached to the distal end of the handle element, thereby creating a force pulling the foundation and the distal end of the handle element toward each other, wherein the hook comprises a stem having a first and movably connected to the foundation opposite the support, and a second end comprising a protrusion, wherein the stem hangs down below the foundation generally parallel to the support, the stem comprising a plurality of slots arranged in series from the first end towards the protrusion, wherein the handle element and the latch element are configured so that when the stem hangs down below the foundation, the stem passes through the hole of the handle, and the slots are configured to independently receive the projection to adjust the latch element to fit different toilet seats with different thicknesses; and c. a cradle attached to the latch element, the cradle having a flat rectangular shape comprising a first edge, a second edge opposite the first edge, a third edge adjacent to the first edge and the second edge, and a fourth edge opposite the third edge and adjacent to the first edge and the second edge, wherein the edges define a first side and a second side opposite the first side, wherein the first side is generally flat and attachable to the toilet cover with a fixation element, wherein the second side comprises a fastening mechanism to attach to the latch element, wherein the fastening mechanism is a pair of bilaterally arranged tabs projecting downwardly from the second side to attach to the notches of the foundation so as to prevent any horizontal movement of the foundation within the cradle, wherein each tab has a fixed end attached to the second side of the cradle, and a free end opposite the fixed end, wherein each tab comprises a lip presented horizontally along each tab in between the fixed end and the free end and protruding towards each other into a space defined by the tabs, wherein when the foundation is seated in the cradle, the tabs secure the foundation from horizontal movement and the lips slide under the foundation to prevent vertical movement.

2. The toilet seat handle of claim 1, wherein the proximal end comprises a lighting mechanism.

3. A toilet seat handle for lifting a toilet seat and a toilet cover, comprising:

a. a cradle mountable to the toilet cover;

b. a latch element releasably attached to the cradle and releasably connectable to the toilet seat;

c. a handle element that comprises i. a distal end;

ii. a proximal end opposite the distal end, wherein when the toilet seat handle is mounted on the toilet seat, the proximal end of the handle element extends beyond an edge of the toilet cover to provide a grasping surface, while the distal end remains underneath the toilet cover; and iii. a slope in between the proximal end and the distal end, wherein when installed, the distal end is positioned below the proximal end due to the slope, wherein the handle element is operatively attached to the latch element in a manner that allows the latch element to release the toilet seat when the handle element is pushed towards the toilet seat, wherein the latch element is adjustably connected to the handle element to fit a variety of toilet seats having different thicknesses, wherein the latch element comprises a hook, wherein the slope comprises a hole, and wherein the hook protrudes through the hole.

4. The toilet seat handle of claim 3, wherein the slope comprises a projection projecting into the hole from the proximal end towards the distal end, wherein the hook comprises a series of vertically arranged slots, and wherein the slots are configured to independently receive the projection to adjust how deep the hook protrudes past the hole.

5. The toilet seat handle oaf claim 4, wherein the cradle comprises a pair of bilaterally arranged tabs projecting downwardly from the cradle to releasably attach to the latch element.

6. The toilet seat handle of claim 5, wherein the latch element comprises a pair of bilaterally arranged notches to receive the bilaterally arranged tabs, wherein when the tabs are seated within the notches horizontal movement of the latch mechanism is prevented.

7. The toilet seat handle of claim 6, wherein each tab comprises a lip presented horizontally along each tab and projecting towards each other, wherein when the latch element is seated in the cradle, the lips prevent vertical movement of the latch element.

8. The toilet seat handle of claim 7, wherein the latch element is hingably coupled via a first hinge with the handle element such that movement of the handle element towards the distal end causes the hook to release the toilet seat.

9. The toilet seat handle of claim 8, wherein the latch element comprises a base attached to the handle element, wherein the hook is attached to the base, wherein the base comprises a support, a foundation attached to the support, and a pair of brackets abutting the foundation and the support, wherein the support and the foundation are movably connected to each other by a second hinge.

10. The toilet seat handle of claim 9, wherein the distal end of the handle element and the foundation of the latch element are connected by a spring so as to create force pulling the foundation and the distal end of the handle element toward each other.

11. A method for lifting a toilet cover or a toilet seat without touching the toilet cover or the toilet seat, comprising:

a. engaging a toilet seat handle attachable to the toilet cover and the toilet seat; and b. lifting the toilet seat handle to raise the toilet seat and the toilet cover, or c. pushing the toilet seat handle inwardly towards the back of the toilet and lifting the handle mechanism to raise the toilet cover only, wherein the toilet seat handle comprises a handle element comprising a slope having a hole, a latch element attached to the handle element, and a cradle attachable to the toilet cover, wherein the latch element comprises a hook releasably attachable to the toilet seat, and wherein the hook protrudes through the hole.

12. The method of claim 11, wherein the cradle is fixed to the toilet seat, and the handle element, and the hook are movably connected such that inward movement of the handle element towards the toilet scat causes the hook to move inwardly towards a back of the toilet seat, thereby dislodging the hook from the toilet seat.

13. The method of claim 11, wherein lifting the handle element, without pushing inwardly, causes the toilet cover to be lifted without the toilet seat.

14. The method of claim 13, wherein when the toilet cover is lowered back down on to of the toilet seat, a ramped face on the hook causes the hook to be temporarily displaced to allow the hook to pass below the toilet seat, wherein once the hook has passed below the toilet seat, a spring pulls the hook in the forward direction to allow the hook to engage the toilet seat.

* * * * *